US006054026A

United States Patent [19]

Van den Bergen et al.

[11] Patent Number: 6,054,026

[45] Date of Patent: Apr. 25, 2000

[54] ELECTROLYTIC CELL FOR REMOVING SILVER FROM SILVER-CONTAINING AQUEOUS LIQUIDS

[75] Inventors: Patrick Van den Bergen, Hove; Bart Verlinden, Tongeren, both of Belgium

[73] Assignee: Agfa-Gevaert, Mortsel, Belgium

[21] Appl. No.: 09/090,751

[22] Filed: Jun. 4, 1998

[30] Foreign Application Priority Data

Jun. 5, 1997 [EP] European Pat. Off. ..... 97201685

[51] Int. Cl.[7] ..... C25B 9/00

[52] U.S. Cl. ..... 204/260; 204/272

[58] Field of Search ..... 204/260, 271, 204/272

[56] References Cited

U.S. PATENT DOCUMENTS 4,367,127 1/1983 Messing et al. ..... 204/260

FOREIGN PATENT DOCUMENTS 2579998 10/1986 France .

2615350 10/1976 Germany .

8600094 1/1986 WIPO .

*Primary Examiner*—Kathryn Gorgos

*Assistant Examiner*—Thomas H Parsons

*Attorney, Agent, or Firm*—Baker Botts L.L.P.

[57] ABSTRACT

The cell comprises a housing (10), an anode (20) positioned within the housing (10), and a cathode (30) surrounding the anode (20) in the housing (10). A perforated screen (28) is located between the anode (20) and the cathode (30). The construction provides the advantage of a higher and more uniform desilvering speed, due to an improved liquid flow over the cathode surface.

8 Claims, 3 Drawing Sheets

ELECTROLYTIC CELL FOR REMOVING SILVER FROM SILVER-CONTAINING AQUEOUS LIQUIDS

FIELD OF THE INVENTION

This invention relates to an apparatus for the electrolytic recovery of silver from solutions containing silver, in particular used photographic solutions such as fixing and bleach-fixing solutions.

BACKGROUND OF INVENTION

Electrolytic silver recovery from used photographic solutions is a common way to extend the life of such solutions.

An apparatus for the electrolytic recovery of silver from solutions containing silver is known from United States patent U.S. Pat. No. 5,378,340 (Van be Wynckel et al. assigned to Agfa-Gevaert NV) issued Jan. 3, 1995. The apparatus comprises an electrolytic cell including: a housing; an anode having an exposed anode portion within the housing; and a cathode having an exposed cathode portion located within the housing and encircling the anode. In use, silver from the silver-containing solution is deposited on the face of the cathode which is directed towards the anode. After the cell is operated for some time, the cathode is removed from the cell and replaced.

In a known method of removing silver from silver-containing aqueous liquids, the liquid to be treated is pumped into the electrolytic cell and electrical power is fed to the anode and the cathode to cause silver to be deposited on the cathode. The cathode is usually removable, and after a certain amount of silver has built up thereon, the cathode is removed and replaced. The build up of silver on the cathode surface during de-silvering has an effect upon the circulation of liquid within the cell, in particular the rate and uniformity of liquid refreshment at the cathode surface. This in turn has an effect upon the uniformity of the desilvering process.

OBJECTS OF INVENTION

It is an object of the present invention to overcome the aforesaid disadvantages.

SUMMARY OF THE INVENTION

We have discovered that this objective and other useful advantages may be achieved when a perforated screen is located between the anode and the cathode.

According to the invention there is provided an electrolytic cell for removing silver from silver-containing aqueous liquids, comprising a housing, an anode positioned within the housing, and a cathode surrounding the anode in the housing, characterised by a perforated screen located between the anode and the cathode.

The invention provides the advantage of a higher and more uniform desilvering speed, thought to be due to an improved liquid flow over the cathode surface.

The housing may be of any suitable shape, but it is preferred to be generally cylindrical, the anode being in the form of a tube positioned axially within the housing. In any case, the anode is encircled by the cathode.

The housing may include an inlet which opens into the cell between the anode and the cathode, and an outlet, for liquid being treated. The outlet may comprises a passage through the anode. The outlet passage may open from the interior of the cell at a level above the level at which the circulation passage opens into the cell, thereby defining a liquid level in the cell.

Preferably, by positioning the lower edge of the cathode above the base of the housing, a sump is defined in the space therebetween. The cell may include a circulation pump connected between the circulation passage and the interior of the housing to circulate liquid being treated through the cell. It is particularly beneficial if this circulation pump injects recirculating liquid tangentially into the sump of the housing, since this arrangement results in efficient mixing of the liquid.

In a preferred embodiment, the housing includes a base and the anode comprises a tube extending from the base. The tube may surround and be concentric with the outlet passage. The hollow interior of the tube may constitute a circulation passage, of annular cross-section, which surrounds the outlet passage.

In a preferred embodiment, the top of the exposed anode portion lies below the top of the exposed cathode portion. This is easily achieved where the anode is supported within the housing from the base thereof. Thus, the housing is preferably formed of electrically non-conductive material, and comprises a base wall and side walls, the anode being supported by the base wall and the cathode being positioned adjacent the side walls.

The cathode is preferably removable from the cell and comprises an electrical connection which may be positioned above the liquid level. In order to enable the cathode to be removed, a removable lid may be provided which, when secured to the housing, serves to hermetically seal the cell. Alternatively, the lid may be integral with the cathode.

The cathode is preferably in sheet form and ideally has a frusto-conical cross-section, with its larger radius end uppermost, that is towards the circular upper opening of the electrolyte cell. This configuration enables easy removal of the cathode even after a silver deposit has built up there-on after use. Usable cathode materials include stainless steel, silver and silver alloys, and other conductive materials, the non-silver containing materials being preferred from the point of view of costs, while the silver-containing materials cause fewer starting-up problems. A cylindrical shape to the housing enables the cathode to be positioned near to the wall of the cell. By arranging for the lower edge of the cathode to be spaced from the base of the housing, it is possible for the reference electrode to be located in a side arm of the housing, the side arm opening into the housing below the level of the cathode.

The material used for the anode is less critical than that used for the cathode, although platinated titanium is usually used.

In a preferred embodiment, the perforated screen is so shaped and positioned as to collect debris falling from the cathode. To achieve this, the cathode has a cylindrical configuration and the perforated screen is shaped to define an annular chamber in which at least a lower edge of the cathode is located.

The perforated screen may include a perforated floor portion adjacent an inlet to the housing, so that liquid entering the cell through the inlet is directed to the space between the cathode and the perforated screen.

Preferably, the perforated screen is spaced from both the anode and the cathode, ideally by at least 10 mm from the cathode. For example, the perforated screen is spaced by from 30 to 40 mm from the cathode.

The perforated screen may be formed of an electrically non-conductive plastics material, which ideally is resistant to the silver-containing liquid, for example PVC.

The perforations of the perforated screen preferably occupy from 30% to 40% of its surface area. If the perforations occupy less of the surface area of the screen, the current flow may be unacceptably reduced. If the perforations occupy more of the surface area, then the benefits of improved liquid flow over the cathode surface may be lost.

The average size of the perforations of the perforated screen is preferably from 8 mm to 10 mm. If the perforations are smaller, the flow of liquid therethrough may be hindered by viscosity effects. We have found that larger perforations result in a reduction in electrolysis speed.

It is convenient for the perforated screen to be removable from the housing.

The cell is preferably operated under negative pressure. A volumetric pump may be connected to the outlet of the cell. Where the cell is hermetically sealed, operation of the volumetric pump can be used to fill the cell with liquid through the inlet, by creating a negative pressure in the cell. The use of this arrangement enables the cell to work under negative pressure and also ensures that the liquid in the cell is de-aerated. This leads to more uniform deposition of silver at the cathode. It is desirable to stop the circulation pump when too much air passes through the outlet. To achieve this, an optical sensor, capable of distinguishing between fluid and air in the outlet, may be positioned between the cell and the volumetric pump, but above the latter. In this way deaeration of the cell can be achieved very quickly. Due to the action of the centrifugal pump, a vortex is formed above the outlet. The air in the vortex is sucked in by the volumetric pump. When too much air is sensed in the outlet, the circulation pump is caused to stop, while the volumetric pump continues to operate. When the circulation pump stops, the vortex remains for about one second, allowing even more air to leave the cell. Once the optical sensor detects fluid, the centrifugal pump starts again, but with less air in the cell. After a few such deaeration cycles, only a small air bubble is left. This bubble is too small to create a vortex and does not therefore enter the pumps.

For optimum performance of the cell, it is important that the potential between the cathode and the reference electrode is accurately controlled. Usually the electrolytic cell further comprises a reference electrode for this purpose. The reference electrode may be positioned in a side arm of the housing, projecting into the sump. Where, for example, an Ag/AgCl reference electrode is used, the potential between the cathode and the reference electrode is about 400 mV. When the unit is to perform optimally, meaning employing the maximum current without causing side reactions to occur, the potential should be measured with an accuracy of some millivolts. The reference electrode may be a calomel type electrode or an Ag/AgCl type electrode. A suitable electrode has been disclosed in application EP 0 598 144 (Agfa Gevaert NV) filed Nov. 11, 1992 entitled "pH Sensitive Reference Electrode in Electrolytic Desilvering".

The "solutions containing silver, " which can be desilvered using the apparatus according to the present invention, include any solution containing silver complexing agents, e.g. thiosulphate or thiocyanate, sulphite ions as an antioxidant and free and complexed silver as a result of the fixing process. The apparatus can also be used with concentrated or diluted used fixing solutions, or solutions containing carried-over developer or rinsing water. Apart from the essential ingredients, such solutions will often also contain wetting agents, buffering agents, sequestering agents and pH adjusting agents.

The apparatus of the present invention can also be used for desilvering bleach-fixing solutions which may additionally contain bleaching agents such as complexes of iron(III) and polyaminocarboxylic acids.

The desilvering process can be carried out batch-wise or continuously, the apparatus being connected to the fixing solution, forming part of a continuous processing sequence.

BRIEF DESCRIPTION OF THE DRAWINGS

The invention will be described by the following illustrative embodiments with reference to the accompanying drawings without the intention to limit the invention thereto, and in which.

DETAILED DESCRIPTION OF THE INVENTION

Figure 1:
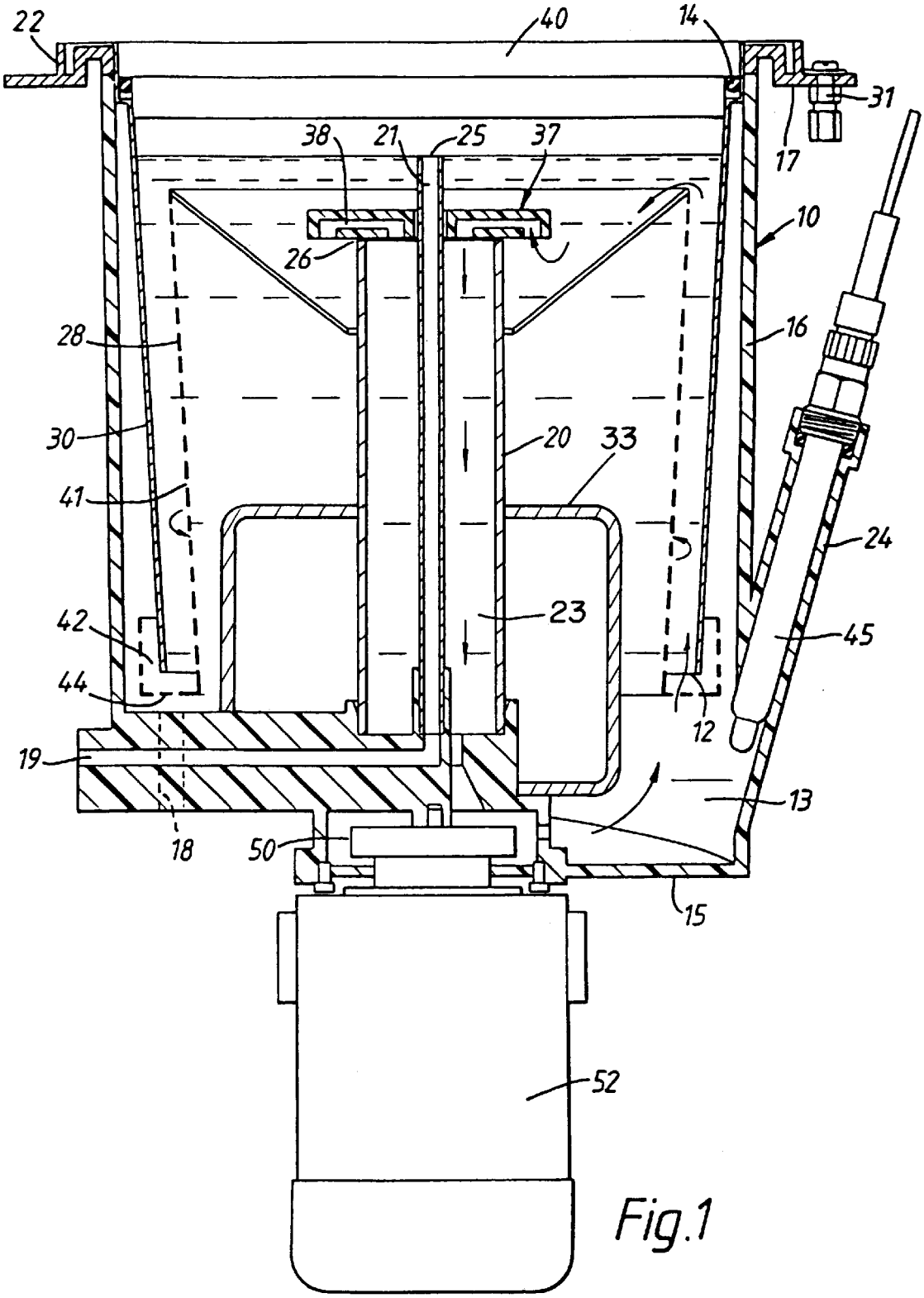
FIG. 1 shows a cross section of an electrolytic cell according to the invention.

As shown in the Figures, an electrolytic cell for removing silver from silver-containing aqueous liquids comprises a generally cylindrical bucket-shaped housing 10, formed of electrically non-conductive material such as PVC, and comprising a base 15, sides 16 and an upper portion 17. The upper diameter of the housing 10 is marginally larger than the lower diameter by a factor of 1.05. Positioned within the cell are a tubular anode 20 and a cylindrical cathode 30.

A perforated screen 28 located between the anode 20 and the cathode 30. The perforated screen 28 is spaced from both the anode 20 and the cathode 30. Specifically, the screen 28 is spaced by about 35 mm from the cathode. The screen 28 is shaped to define an annular chamber 42 in which at least a lower edge 12 of the cathode 30 is located, the screen having a perforated floor portion 44. The inlet 18 is adjacent the perforated floor portion 44 of the screen 28. The perforated screen 28 is removable from the housing 10.

The screen 28 is formed of PVC, which is electrically non-conductive and resistant to the silver-containing liquid. The perforations 41 of the perforated screen 28 occupy from about 30% to 40% of the screen surface area and are generally circular with an average diameter ranging from about 8 mm to about 10 mm, preferably about 9 mm. The screen 28 is so shaped and positioned as to collect debris falling from the cathode 30.

A liquid inlet 18 leads through the base 15 of the cell and opens into the cell between the anode tube 20 and the cathode 30. An outlet 19 opens from the base 15 of the cell and leads to a relatively narrow PVC tube defining an outlet passage 21. An annular circulation passage 23 is thereby defined, which surrounds the outlet passage 21 and is concentric therewith. The outlet passage 21 opens from the interior of the cell at a level 25 above the level 26 at which the circulation passage 23 opens into the cell, thereby defining a liquid level in the cell. An annular PVC cap 37 sits on top of the anode tube 20 and includes a U-shaped cross-section channel 38 opening downwards at one end into the circulation passage 23 and at the other end into the interior of the cell.

The cathode 30, formed for example of stainless steel covered with a thin layer of silver, is located in the cell 10 with its faces spaced from the sides 16. The lower edge 12 of the cathode is spaced above the base of the housing so as to leave a sump 13 from which a side arm 24 of the housing leads.

The anode 20, in the form of a platinised titanium tube, is secured to the base 15 of the cell by means of a contact piece (not shown in detail) integral with the housing of the cell, which contact piece acts as an electrical connector for the anode. The anode tube 20 lies along the axis of the housing 10.

Excessive build up of deposited silver towards the lower edge of the cathode 30 is reduced by ensuring that the bottom of the cathode 30 is positioned below the bottom of the exposed portion of anode 20.

In particular this is achieved by the provision of a raised base portion 33, formed of an electrically non-conductive material such as PVC, which serves to shield the lower part of the anode 20 from the cathode 30. In this manner, electrical field lines do not extend from that portion of the anode 20 which is positioned below the level of the cathode 30. The raised base portion 33 also serves to control the vortex flow of liquid within the housing.

A centrifugal circulation pump 50, together with an associated pump motor 52, is connected to the base of the cell and serves to circulate the liquid in the cell by removing liquid from the circulation passage 23 and injecting it tangentially into the sump 13 of the housing 10, as indicated by the arrows in FIG. 1.

The reference electrode 45 is positioned in the side arm 24 of the housing and protrudes into the sump 13 of the cell.

A suitable reference electrode is a pH sensitive glass electrode such as a YOKOGAWA SM21/AG2 or an INGOLD HA265-58/120 glass electrode. Not only does the raised base portion 33 influence the silver build-up towards the lower edge of the cathode 30 by screening it from the anode 20, but the reference electrode 45 more accurately measures the correct voltage because the electric field is more uniform.

The upper part 17 of the cell is in the form of a neck portion having an opening defined by a stainless steel ring 22. The stainless steel ring 22 is permanently fixed to one end of a bolt 31 which extends through the wall of the cell and provides a connector for the cathode 30. Positioned in the neck of the cell, below the level of the annular ring 22, is a sealing ring 14.

The apparatus further comprises a lid 40 so shaped as to fit into the neck portion of the cell. The lid 40 is formed of electrically non-conductive material such as PVC.

The cathode 30, formed for example of a stainless steel sheet having a thickness of 100 $\mu$m, is wrapped around into a cylindrical configuration. The cathode 30 is provided with a deformable upper edge portion, formed by the provision of slots (not shown), the sheet material of which the cathode is formed being sufficiently resilient to allow the upper edge portion to bend outwardly in response to outwardly directed force.

Figure 3:
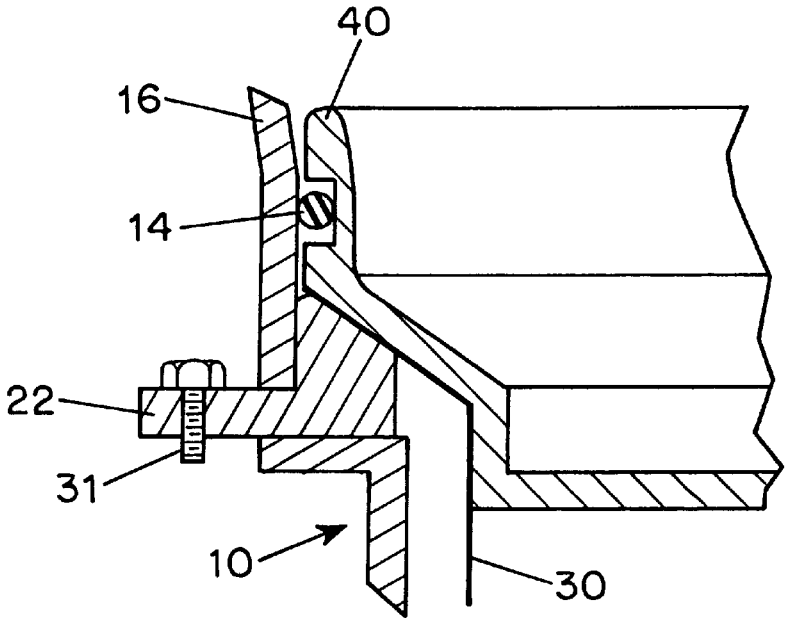
FIG. 3 shows an enlarged section of a cell according to the invention and comprising a sealing with a circular section.
Figure 4:
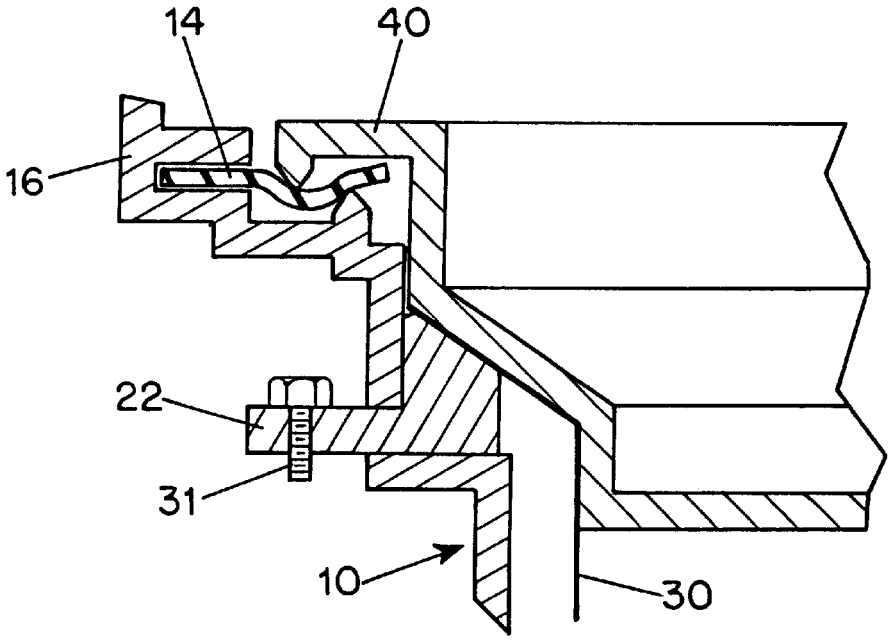
FIG. 4 shows an enlarged section of a cell comprising a sealing with an initially rectangular section.

As the lid is screwed into place, a contact surface on the lid bears against the upper edge portion of the cathode 30, causing the upper edge portions to bend outwardly against the annular surface of the ring 22 (see also the illustrations with greater details of FIGS. 3 and 4, which will be described in the following paragraphs). Tightening of the lid causes the upper edge portion to be clamped firmly by the lid against the ring 22, thereby establishing good electrical contact there-between. In the closed position of the lid, the sealing ring 14 bears against the lower edge of the lid 40, thereby forming a tight seal.

According to further preferred embodiments of the present invention, sealing ring 14 comprises a circular section (also known as an "O-ring") or a flat (or rectangular) section. Enlarged views of two thus preferred sealings are given in FIGS. 3 and 4. Evidently, the geometry of the indicated cross-sections may be deformed during application; so, FIG. 4 illustrates a deformation of an initially flat section of a sealing ring 14.

Figure 2:
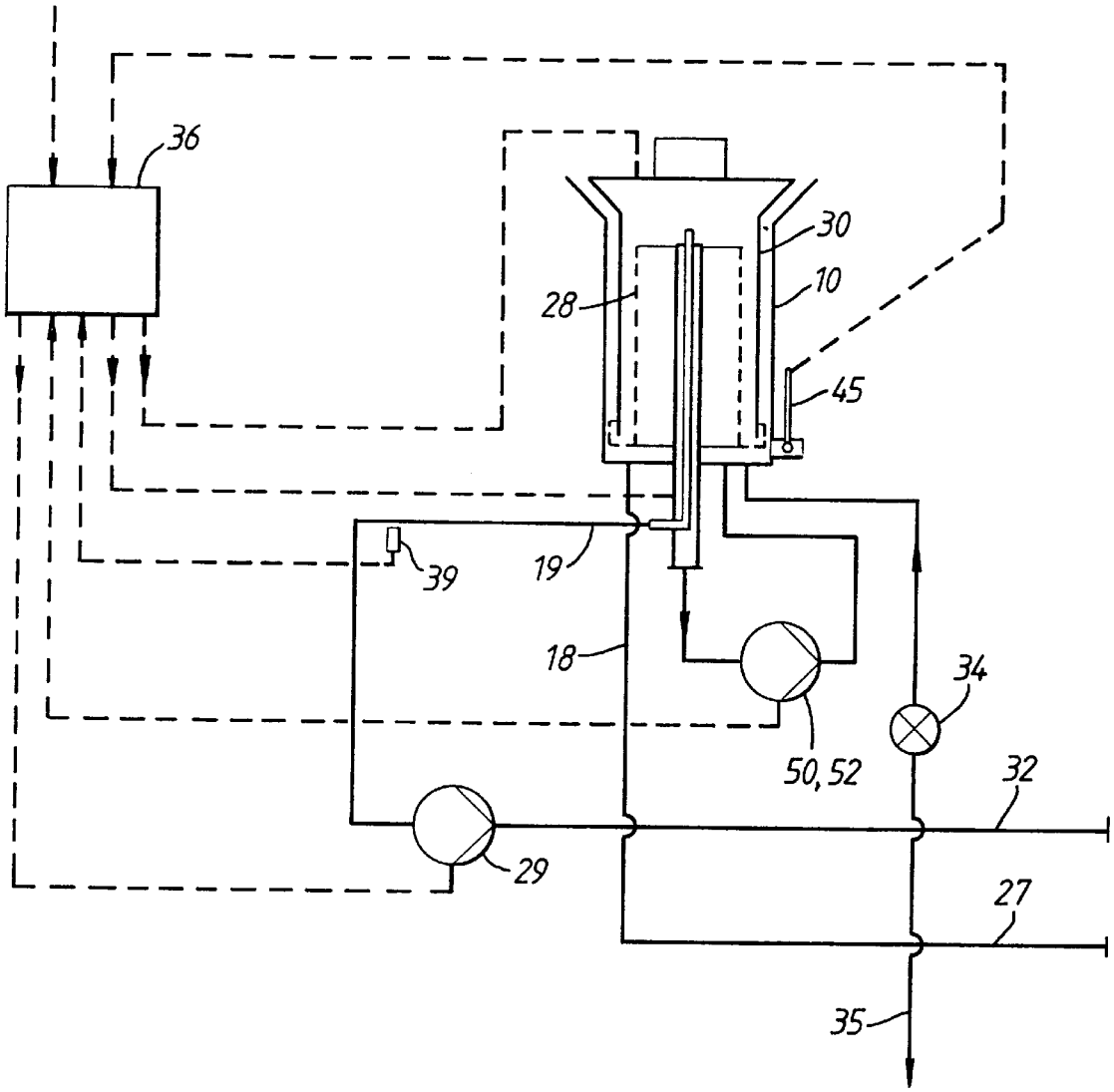
FIG. 2 shows schematically the liquid and electrical connections to the cell.

The liquid and electrical connections to the cell are shown schematically in FIG. 2. Fixer or other silver-containing liquid enters along an inlet line 27 having an internal diameter of, for example, 10 mm.

When the cell is initially empty, but the lid 40 is attached hermetically sealing the cell, operation of a volumetric pump 29 extracts air from the cell and pulls liquid from the inlet line 27 into the cell through the inlet 18. Treated liquid from the cell is pumped by the pump 29 along an exit line 32, of say 10 mm diameter at say 1 liter/min. An optical level sensor 39 is provided in a cavity adjacent the exit line 32 at a position above the level of the volumetric pump 29. This sensor stops the circulation pump 50 each time too much air passes through the cavity. The volumetric pump 29 continues to operate however. By this arrangement, de-aeration of the cell proceeds quickly. Due to the action of the circulation pump 50, a vortex is formed above the outlet passage 21. The air of the vortex is sucked in by the volumetric pump 29. This air is sensed by the sensor 39 which causes the circulation pump 50 to stop. The vortex remains for about one second, allowing even more air to leave the cell. Once the sensor 39 detects liquid, the circulation pump 50 is caused to re-start. Further pumping not only continues to fill the cell, but also de-aerates the liquid in the cell. After 2 to 4 de-aeration cycles, in a span of less than a minute, only a small air bubble is left above the outlet passage 21. This bubble is too small to create a vortex and no further air enters the outlet passage 21. The liquid is circulated through the cell by the circulation pump 50 at, for example, 20 liters/min.

The cell is then operated under usual conditions, during which a silver deposit builds up on the cathode 30, primarily on the inside surface thereof. Electronic circuitry 36 controls the de-silvering process in a known manner. After a period of time determined by the required amount of deposited silver, the operator unscrews the lid 40 and lifts the cathode 30 out of the cell. Due to the frusto-conical cross-section of the housing 10, the sides of the cathode will not foul against the ring 22, even when some small amount of silver deposit has built up on the outside surface thereof. The silver deposit is then removed from the cathode, which may then be re-used as desired or replaced by another cathode of similar construction for the de-silvering of a further batch of electrolyte. The cell may be drained via a drain valve 34 and drain line 35.

Now, particular attention may be focused on two specific requisites to be accomplished by the electrolytic cell. One, a good sealing function has to be guaranteed. This is provided by the fact that, as mentioned before, when the lid 40 is attached to the housing 10 of the cell and the sealing ring 14 is mounted in the neck of the housing 10, the cell is hermetically sealed, especially as the volumetric pump 29 extracts air from the cell and thus provides that the cell is operated under negative pressure. It has been proved in practice that sealing by line-contacts is very efficient.

Two, a good electrical contact between contact ring 22 and cathode 30 has to be guaranteed also. In the case of using a flat sealing ring 14 conforming to FIG. 4, a greater flexibility of the sealing ring itself may be expected, evidently dependent on the exact kinds and dimensions of the circular versus flat sealing rings. Therefor, greater geometrical tolerances on the mechanical parts of the cell can be accepted, which provides an extra advantage. Per further consequence of the flexibility, the force needed for a sufficient displacement of the lid into the cell may be smaller than in the case of a circular sealing ring 14 conforming to FIG. 3. And, for a same negative pressure in the cell, the electrical contact between ring 22 and cathode 30 may be more intense with a flat ring conforming FIG. 4, than in the case of a circular sealing ring 14 conforming FIG. 3.

REFERENCE NUMBER LIST housing 10
lower edge 12
sump 13
sealing ring 14
base 15
sides 16
upper portion 17
outlet 19
inlet 18
anode tube 20
outlet passage 21
ring 22
circulation passage 23
side arm 24
liquid level 25
circulation level 26
inlet line 27
screen 28
vol pump 29
cathode 30
bolt 31
outlet line 32
drain valve 34
raised base portion 33
drain line 35
controller 36
cap 37
U-channel 38
sensor 39
lid 40
perforations 41
annular chamber 42
floor portion 44
reference electrode 45
circ pump 50
pump motor 52

We claim:

1. An electrolytic cell for removing silver from silver-containing aqueous liquids, comprising:

a housing;

an anode positioned within said housing;

a cathode surrounding said anode in said housing; and a perforated screen located between said anode and said cathode, wherein said perforated screen is spaced from both said anode and said cathode.

2. An electrolytic cell according to claim 1, wherein said perforated screen is formed of an electrically non-conductive plastic material.

3. An electrolytic cell according to claim 1, wherein the perforations of said perforated screen occupy from 30% to 40% of the surface area of the screen.

4. An electrolytic cell according to claim 1, wherein the average size of the perforations of said perforated screen is from 8 mm to 10 mm.

5. An electrolytic cell according to claim 1, wherein said perforated screen is so shaped and positioned as to collect debris falling from said cathode.

6. An electrolytic cell according to claim 5, wherein said cathode has a cylindrical configuration and said perforated screen is shaped to define an annular chamber in which at least a lower edge of said cathode is located.

7. An electrolytic cell according to claim 1, wherein said housing includes an inlet for liquid to be treated and said perforated screen includes a perforated floor portion adjacent said inlet.

8. An electrolytic cell according to claim 1, wherein said perforated screen is removable from said housing.

* * * * *